US008281601B2

(12) United States Patent
McMahan et al.

(10) Patent No.: US 8,281,601 B2
(45) Date of Patent: Oct. 9, 2012

(54) SYSTEMS AND METHODS FOR REINTRODUCING GAS TURBINE COMBUSTION BYPASS FLOW

(75) Inventors: Kevin Weston McMahan, Greer, SC (US); Thomas Edward Johnson, Greer, SC (US); Stanley Kevin Widener, Greenville, SC (US)

(73) Assignee: General Electric Company, Schenectady, NY (US)

( * ) Notice: Subject to any disclaimer, the term of this patent is extended or adjusted under 35 U.S.C. 154(b) by 802 days.

(21) Appl. No.: 12/408,326

(22) Filed: Mar. 20, 2009

(65) Prior Publication Data

US 2010/0236249 A1 Sep. 23, 2010

(51) Int. Cl.
*F02C 1/00* (2006.01)

(52) U.S. Cl. ..... 60/785; 60/752; 60/782; 60/806

(58) Field of Classification Search ..... 60/752, 60/760, 782, 785, 806
See application file for complete search history.

(56) References Cited

U.S. PATENT DOCUMENTS

| | | | | |
|---|---|---|---|---|
| 2,584,899 | A * | 2/1952 | McLeod | 415/115 |
| 3,657,882 | A * | 4/1972 | Hugoson | 60/798 |
| 4,487,016 | A * | 12/1984 | Schwarz et al. | 60/204 |
| 5,048,288 | A * | 9/1991 | Bessette et al. | 60/226.1 |
| 5,349,812 | A | 9/1994 | Taniguchi et al. | |
| 5,394,687 | A * | 3/1995 | Chen et al. | 60/785 |
| 5,557,920 | A | 9/1996 | Kain | |
| 5,619,855 | A * | 4/1997 | Burrus | 60/736 |
| 5,819,525 | A * | 10/1998 | Gaul et al. | 60/806 |
| 5,906,093 | A * | 5/1999 | Coslow et al. | 60/777 |
| 5,924,276 | A | 7/1999 | Mowill | |
| 6,065,282 | A * | 5/2000 | Fukue et al. | 60/39.182 |
| 6,250,061 | B1 * | 6/2001 | Orlando | 60/772 |
| 6,293,088 | B1 * | 9/2001 | Moore et al. | 60/39.3 |
| 6,449,956 | B1 | 9/2002 | Kolman et al. | |
| 6,568,188 | B2 | 5/2003 | Kolman et al. | |
| 6,574,966 | B2 * | 6/2003 | Hidaka et al. | 60/806 |
| 6,769,257 | B2 * | 8/2004 | Kondo et al. | 60/730 |
| 6,860,098 | B2 | 3/2005 | Suenaga et al. | |
| 6,860,108 | B2 * | 3/2005 | Soechting et al. | 60/752 |
| 7,000,404 | B2 * | 2/2006 | Palmisano et al. | 60/782 |
| 7,152,409 | B2 * | 12/2006 | Yee et al. | 60/777 |
| 7,340,880 | B2 | 3/2008 | Magoshi et al. | |
| 2003/0024234 | A1 * | 2/2003 | Holm et al. | 60/39.463 |
| 2006/0016195 | A1 | 1/2006 | Dalla Betta et al. | |
| 2007/0151257 | A1 * | 7/2007 | Maier et al. | 60/782 |

OTHER PUBLICATIONS

Lefebvre, A.H., Gas Turbine Combustion, second edition, Taylor & Francis, Philadelphia, PA, 1999, pp. 8-10.*

* cited by examiner

*Primary Examiner* — Ehud Gartenberg
*Assistant Examiner* — Lorne Meade
(74) *Attorney, Agent, or Firm* — Sutherland Asbill & Brennan LLP

(57) ABSTRACT

A system and method for reintroducing gas turbine combustion bypass flow. The system may include a combustor body, wherein the combustor body includes a reaction zone for primary combustion of fuel and air, and a casing enclosing the combustor body and defining an annular passageway for carrying compressor discharge air into the combustor body at one end. The system further may include a reintroduction manifold for receiving combustor bypass air extracted from the compressor discharge air in the annular passageway, and one or more reintroduction slots in communication with the reintroduction manifold for injecting the combustor bypass air into the combustor body downstream of the reaction zone. The method may include extracting combustor bypass air from the annular passageway, transporting the combustor bypass air to a reintroduction manifold, and reintroducing the combustor bypass air into the combustor body through one or more reintroduction slots in communication with the reintroduction manifold.

19 Claims, 3 Drawing Sheets

SYSTEMS AND METHODS FOR REINTRODUCING GAS TURBINE COMBUSTION BYPASS FLOW

TECHNICAL FIELD

The present application relates generally to gas turbines and more particularly relates to systems and methods for reintroducing gas turbine combustion bypass flow.

BACKGROUND OF THE INVENTION

A gas turbine includes a compressor section that produces compressed air that is subsequently heated by burning a fuel in the reaction zone of a combustion section. The hot gas from the combustion section is directed to a turbine section where the hot gas is used to drive a rotor shaft to produce power. The combustion section typically includes a casing that forms a chamber that receives compressor discharge air from the compressor section. A number of cylindrical combustors typically are disposed in the chamber and receive the compressor discharge air along with the fuel to be burned. A duct is connected to the aft end of each combustor and serves to direct the hot gas from the combustor to the turbine section.

Due to rising fuel costs, gas fired power plants that were designed to operate at mostly full power output are now being operated on a intermittent basis. Coal and nuclear energy generally may make up the majority of stable power output. Gas turbines increasingly are being used to make up the difference during peak demand periods. For example, a gas turbine may be used only during the daytime and then taken off line during the nighttime when the power demand is lower.

During load reductions, or "turndowns," combustion systems must be capable of remaining in emissions compliance down to about fifty percent (50%) of fill rated load output, or "base load." In order to maintain acceptable fuel-to-air ratios at the required turndown levels and to control the formation of oxides of nitrogen ("NOx") and carbon monoxide (CO), considered atmospheric pollutants, it is sometimes desirable to cause a portion of the compressor discharge air from the compressor section to bypass the combustors.

Previous bypass systems have accomplished this by reinjecting the bypass flow as a dilution jet directly into the duct that directs the hot gas to the turbine. This approach may suffer from several drawbacks. Reinjecting the bypass flow as a single dilution jet can cause flame quenching and high levels of atmospheric pollutants in combustion systems. In addition, introducing combustor bypass air directly into the duct at one localized spot may create distortions in the temperature pattern and profile of the hot gas flowing into the turbine section. Moreover, the effect on pattern and profile generally cannot be tailored to meet downstream hardware thermal requirements.

There is a desire therefore to provide an apparatus for causing a portion of the compressor discharge air to bypass the combustor and enter the hot gas flow path downstream of the combustor. Such a bypass may reduce the concern for quenching and atmospheric pollutants, prevent distortions in the gas temperature profile, and allow tailoring of the pattern and profile factors to meet downstream hardware thermal requirements.

SUMMARY OF THE INVENTION

In one embodiment, the present application provides a combustor for a gas turbine. The combustor may include a combustor body, wherein the combustor body includes a reaction zone for primary combustion of fuel and air. The combustor also may include a casing enclosing the combustor body and defining an annular passageway for carrying compressor discharge air into the combustor body at one end thereof. The combustor further may include a reintroduction manifold for receiving combustor bypass air extracted from the compressor discharge air in the annular passageway, and one or more reintroduction slots in communication with the reintroduction manifold for injecting the combustor bypass air into the combustor body downstream of the reaction zone. The combustor also may include one or more cooling holes for providing cooling air to the one or more reintroduction slots.

In another embodiment, the present application provides a combustor for a gas turbine. The combustor may include a combustor body, wherein the combustor body includes a reaction zone for primary combustion of fuel and air. The combustor also may include a casing enclosing the combustor body and defining an annular passageway for carrying compressor discharge air into the combustor body at one end thereof. The combustor further may include an extraction manifold for extracting combustor bypass air from the annular passageway, a reintroduction manifold for receiving combustor bypass air extracted from the annular passageway, and a conduit for transporting the combustor bypass air from the extraction manifold to the reintroduction manifold. The combustor also may include one or more reintroduction slots in communication with the reintroduction manifold for injecting the combustor bypass air into the combustor body downstream of the reaction zone, and one or more cooling holes for providing cooling air to the one or more reintroduction slots.

In a further embodiment, the present application provides a method for bypassing a combustor of a gas turbine. The method may include extracting combustor bypass air from an annular passageway including compressor discharge air, wherein the annular passageway is defined by the space between a combustor body and a casing enclosing the combustor body. The method also may include transporting the combustor bypass air to a reintroduction manifold. The method further may include reintroducing the combustor bypass air into the combustor body through one or more reintroduction slots in communication with the reintroduction manifold, wherein the one or more reintroduction slots are downstream of a reaction zone in the combustor body.

These and other features of the present application will become apparent to one of ordinary skill in the art upon review of the following detailed description when taken in conjunction with the several drawings and the appended claims.

BRIEF DESCRIPTION OF THE DRAWINGS

The present application may be better understood with reference to the following figure. Matching reference numerals designate corresponding parts throughout the figure, and components in the figure are not necessarily to scale.

DETAILED DESCRIPTION OF THE INVENTION

Figure 1:
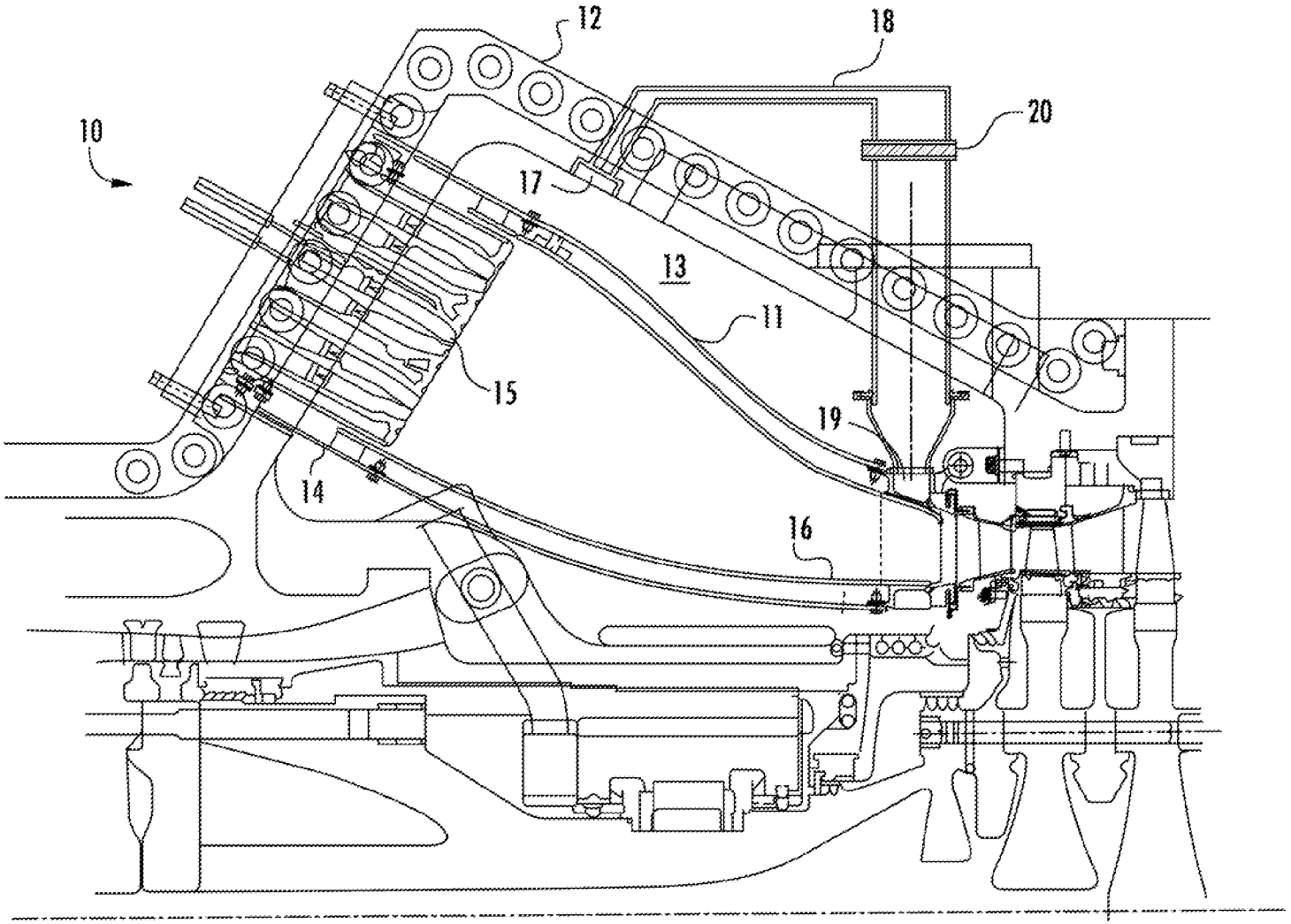
FIG. 1 is a cross-sectional illustration of a combustor for a gas turbine as is described herein.

Described below are embodiments of systems and methods for reintroducing gas turbine combustion bypass flow. Referring now to the drawings, FIG. 1 shows a cross-sectional illustration of a combustor 10 of a gas turbine of an embodiment of the present application. The gas turbine further may include a compressor section and a turbine section (partially shown to the left and right of the combustor).

The combustor 10 of the gas turbine may include a combustor body 11. The combustor 10 further may include a casing 12 enclosing the combustor body 11. Together the combustor body 11 and the casing 12 may define an annular passageway 13. Generally described, the annular passageway 13 receives compressed air discharged from the compressor. The annular passageway 13 carries the compressor discharge air to the combustor body 11 to a head end 14 thereof. The combustor body 11 may further include a reaction zone 15 for the primary combustion of a fuel. The fuel and compressed air generally are introduced to the reaction zone 15 where they combust to form a hot gas. A duct 16 may form the aft end of the combustor body 11. The duct 16 may direct the hot gas from the reaction zone 15 to a turbine where the hot gas may be expanded to drive a rotor shaft to produce power.

At certain predetermined turndown levels, it may be desirable to cause a portion of the compressor discharge air from the compressor section to bypass the reaction zone 15 of the combustor 10. In accordance with an embodiment of the application, the combustor 10 may include an extraction manifold 17 for extracting a portion of the compressor discharge air from the annular passageway 13. The portion of the compressor discharge air extracted from the annular passageway 13 forms the combustor bypass air. The extraction manifold 17 may be in communication with a conduit 18 for transporting the combustor bypass air from the extraction manifold 17 to a reintroduction manifold 19. The compressor 10 may further include a valve 20 to regulate the combustor bypass air flowing to the reintroduction manifold 19. In a particular embodiment, the valve 20 may be disposed within the conduit 18.

Figure 2:
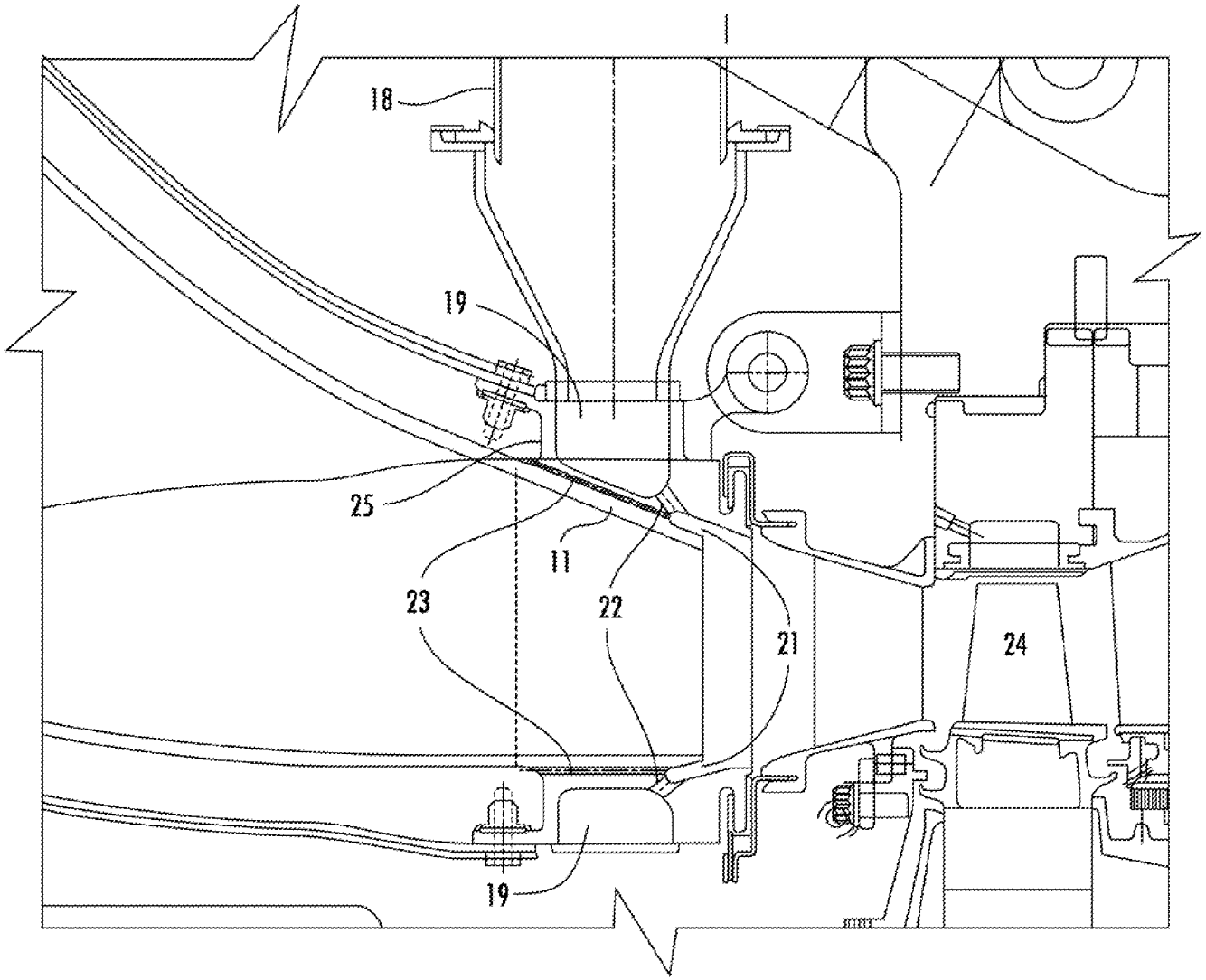
FIG. 2 is a detailed illustration of a reintroduction manifold as is described herein.
Figure 3:
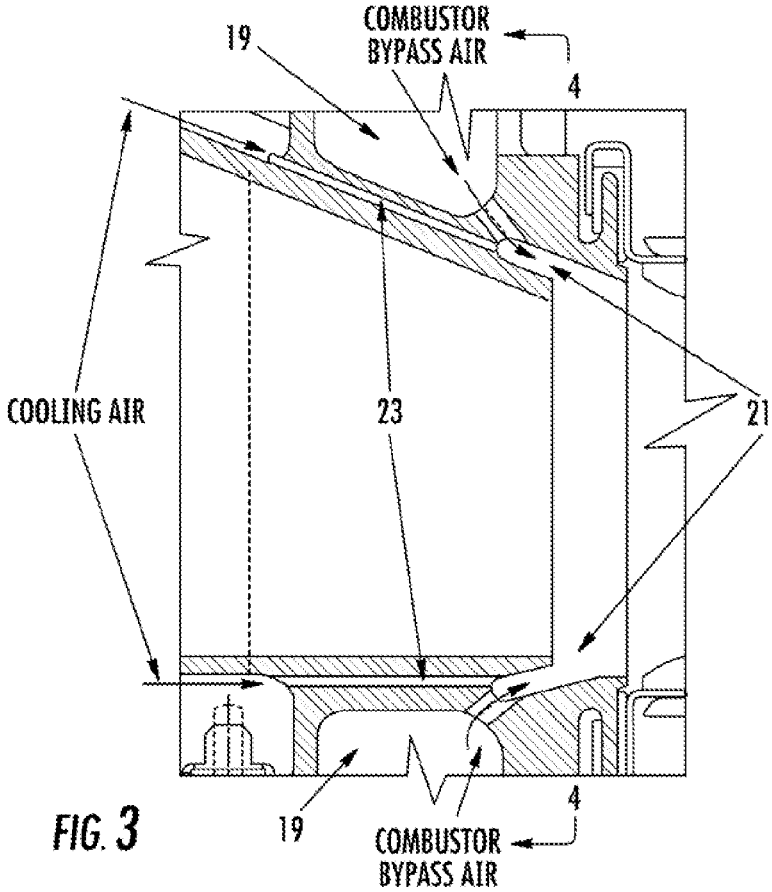
FIG. 3 is a detailed illustration of the reintroduction slot(s) and cooling holes.
Figure 4A:
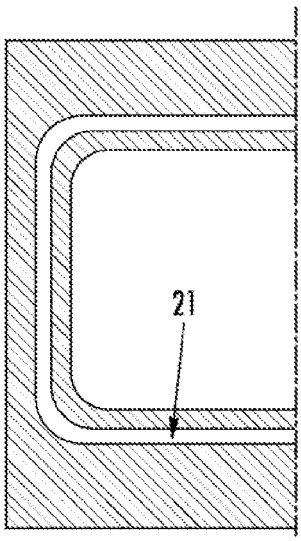
FIG. 4A is a partial axial view of FIG. 3 illustrating an embodiment with a continuous annular reintroduction slot in communication with the reintroduction manifold.
Figure 4B:
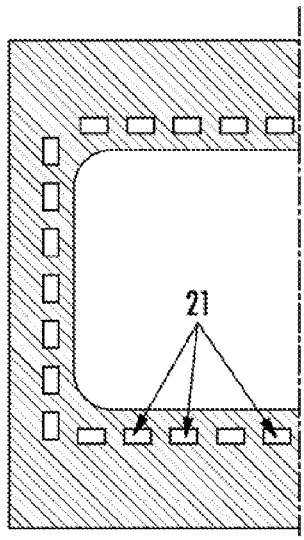
FIG. 4B is a partial axial view of FIG. 3 illustrating another embodiment with a plurality of reintroduction slots in communication with the reintroduction manifold.

FIG. 2 and FIG. 3 show a more detailed illustration of a reintroduction manifold of an embodiment of the present application. The reintroduction manifold 19 may receive combustor bypass air through a conduit 18. The reintroduction manifold 19 may be in communication with one or more reintroduction slots 21 located in the wall of the combustor body 11. In a particular embodiment of the application, the reintroduction slots 21 may include a continuous annular slot (illustrated in FIG. 4A) located in the wall of the combustor body 11. In another embodiment of the application, the reintroduction slots 21 may include a number of slots (illustrated in FIG. 4B) located in the wall of the combustor body 11. In yet another embodiment of the application, the slots may be equally spaced from one another (illustrated in FIG. 4B) about the combustor body 11. The one or more reintroduction slots 21 generally may be in communication with the reintroduction manifold 19 through one or more holes 22 connecting the reintroduction slots 21 with the reintroduction manifold 19. After reintroduction, the combustor bypass air may pass to a first stage of the turbine section 24 where it may provide useful work.

At turndown levels, the combustor bypass flow through the reintroduction manifold 19 and the one or more reintroduction slots 21 generally is sufficient to provide cooling to the reintroduction manifold 19 and reintroduction slots 21 and to ensure that the temperatures are maintained within acceptable levels. At base load, however, the amount of combustor bypass flow is minimal and may be insufficient to maintain the temperature of the reintroduction manifold 19 and reintroduction slots 21 within acceptable levels. In particular embodiments, the combustor 10 of the present application may include a number of cooling holes 23 for providing cooling air to the one or more reintroduction slots 21. In particular embodiments, cooling air independent of the combustor bypass air may pass through the cooling holes 23 to provide cooling air to the one or more reintroduction slots 21. In other embodiments, cooling air independent of the combustor bypass air may continuously pass through the cooling holes 23 to provide cooling air to the one or more reintroduction slots 21. In still further embodiments, air used to cool a combustor aft frame 25 may pass through the cooling holes 23 to provide a constant level of cooling to the reintroduction slots 21. The cooling holes 23 further may be sized to ensure that temperatures remain within acceptable levels during periods of minimum combustor bypass flow. Further, the low pressure region created by the reintroduction slots 21, the ejector effect of the cooling holes 23, and the cool air provided by the cooling holes 23 may provide additional backflow margin.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A combustor for a gas turbine configured for reintroducing a combustor bypass air extracted from a compressor discharge air, comprising:

a combustor body, wherein the combustor body comprises a reaction zone for primary combustion;

a casing enclosing the combustor body and defining an annular passageway therebetween for carrying the compressor discharge air into the combustor body at one end thereof;

a reintroduction manifold for receiving the combustor bypass air extracted from the compressor discharge air in the annular passageway;

one or more reintroduction slots in communication with the reintroduction manifold for injecting the combustor bypass air into the combustor body downstream of the reaction zone; and one or more cooling holes for providing cooling air independent of the combustor bypass air to the one or more reintroduction slots.

2. The combustor of claim 1, wherein the one or more cooling holes provides cooling air continuously to the one or more reintroduction slots.

3. The combustor of claim 1, further comprising a valve to regulate the combustor bypass air flowing to the reintroduction manifold.

4. The combustor of claim 1, further comprising an extraction manifold for extracting the combustor bypass air from the annular passageway.

5. The combustor of claim 4, further comprising a conduit for transporting the combustor bypass air from the extraction manifold to the reintroduction manifold.

6. The combustor of claim 1, wherein the one or more reintroduction slots comprise a continuous annular slot in communication with the reintroduction manifold.

7. The combustor of claim 1, wherein the one or more reintroduction slots comprise a plurality of slots in communication with the reintroduction manifold.

8. The combustor of claim 7, wherein the plurality of slots are equally spaced from one another about the combustor body.

9. A combustor for a gas turbine configured for reintroducing a combustor bypass air extracted from a compressor discharge air, comprising:

a combustor body, wherein the combustor body comprises a reaction zone for primary combustion;

a casing enclosing the combustor body and defining an annular passageway therebetween for carrying the compressor discharge air into the combustor body at one end thereof;

an extraction manifold for extracting the combustor bypass air from the annular passageway;

a reintroduction manifold for receiving the combustor bypass air extracted from the annular passageway;

a conduit for transporting the combustor bypass air from the extraction manifold to the reintroduction manifold;

one or more reintroduction slots in communication with the reintroduction manifold for injecting the combustor bypass air into the combustor body downstream of the reaction zone; and one or more cooling holes for providing cooling air independent of the combustor bypass air to the one or more reintroduction slots.

10. The combustor of claim 9, wherein the one or more cooling holes provides cooling air continuously to the one or more reintroduction slots.

11. The combustor of claim 9, wherein the one or more reintroduction slots comprises a continuous annular slot in communication with the reintroduction manifold.

12. The combustor of claim 9, wherein the one or more reintroduction slots comprise a plurality of slots in communication with the reintroduction manifold.

13. The combustor of claim 12, wherein the plurality of slots are equally spaced from one another about the combustor body.

14. A method for bypassing a combustor bypass air around a combustor of a gas turbine, comprising:

extracting the combustor bypass air from an annular passageway comprising compressor discharge air, wherein the annular passageway is defined by the space between a combustor body and a casing enclosing the combustor body;

transporting the combustor bypass air to a reintroduction manifold;

reintroducing the combustor bypass air into the combustor body through one or more reintroduction slots in communication with the reintroduction manifold, wherein the one or more reintroduction slots are downstream of a reaction zone in the combustor body; and providing cooling air independent of the combustor bypass air to the one or more reintroduction slots through one or more cooling holes.

15. The method of claim 14, wherein transporting the combustor bypass air to a reintroduction manifold comprises transporting the combustor bypass air to the reintroduction manifold through a conduit.

16. The method of claim 14, further comprising regulating the transporting of the combustor bypass air to the reintroduction manifold using a valve.

17. The method of claim 14, wherein the one or more reintroduction slots comprises a continuous annular slot in communication with the reintroduction manifold.

18. The method of claim 14, wherein the one or more reintroduction slots comprises a plurality of slots in communication with the reintroduction manifold.

19. The method of claim 18, wherein the plurality of slots are equally spaced from one another about the combustor body.

* * * * *